US005730301A

United States Patent [19]

Welch et al.

[11] Patent Number: 5,730,301

[45] Date of Patent: Mar. 24, 1998

[54] WHEEL MOUNTING METHOD AND APPARATUS FOR DISHWASHER RACK

[75] Inventors: Rodney M. Welch; Thomas M. Johnson, both of Newton, Iowa

[73] Assignee: Maytag Corporation, Newton, Iowa

[21] Appl. No.: 551,760

[22] Filed: Nov. 7, 1995

Related U.S. Application Data

[63] Continuation-in-part of Ser. No. 405,731, Mar. 17, 1995, Pat. No. 5,605,236.

[51] Int. Cl.[6] ..... A47F 7/00

[52] U.S. Cl. ..... 211/41.1

[58] Field of Search ..... 211/41.1, 71; 220/97, 220/23.4; 312/311

[56] References Cited

U.S. PATENT DOCUMENTS 3,261,647 7/1966 Stewart .
3,433,363 3/1969 Clearman et al. .
3,672,743 6/1972 Pompey .
3,744,646 7/1973 Duncan et al. .
4,019,794 4/1977 Rowe .
4,057,872 11/1977 Schmidt .
4,402,556 9/1983 Schwind .
4,449,765 5/1984 Lampman .
5,345,959 9/1994 Matteson .

*Primary Examiner*—Alvin C. Chin-Shue
*Assistant Examiner*—Sarah L. Purol
*Attorney, Agent, or Firm*—Zarley, McKee, Thomte, Voorhees, & Sease

[57] ABSTRACT

A wheel mounting method and apparatus for dishwasher racks includes a plurality of cross members in the dishwasher rack, each of which terminate at its opposite ends in a wheel shaft. An elongated groove extends along the length of each cross frame member and into the wheel shafts. A reinforcing member is inserted within the groove and is held in place by bushings which are mounted on the opposite ends of the wheel shaft. The wheels are mounted on the bushings and are held in place on the ends of the shafts. The bushings may be snapped onto the outer ends of the shaft.

19 Claims, 3 Drawing Sheets

WHEEL MOUNTING METHOD AND APPARATUS FOR DISHWASHER RACK

This is a continuation-in-part of application Ser. No. 08/405,731 now U.S. Pat. No. 5,605,236 filed Mar. 17, 1995.

BACKGROUND OF THE INVENTION

Dishwasher racks are conventionally constructed from wire and then coated with a plastic such as vinyl. The rusting of the wire can be a problem if pinholes are left in the plastic coating or if the plastic coating becomes worn or damaged. It is therefore desirable to make a rack which is formed entirely of plastic.

However, one disadvantage of plastic racks is that they may not have sufficient strength to support the weight of the contents of the rack. If enough plastic is used to provide sufficient structural strength, there may be insufficient access to the dish ware within the rack by the water jets of the dishwasher.

Prior patent application Ser. No. 08/405,731 filed Mar. 17, 1995 discloses a dishwasher rack having metal reinforcing members secured to the various plastic members of the dishwasher rack. However, there is need for a simple method for assembling the reinforcing members to the dishwasher rack.

Most dishwasher racks also include wheels mounted thereon. The wheels roll on an interior track within the dishwasher for permitting the insertion and removal of the dishwasher rack. These wheels are often secured or fastened by screws or other devices which complicate the construction assembly process and which also are susceptible, if constructed from metal, to rusting.

Therefore, a primary objective of the present invention is the provision of an improved wheel mounting method and apparatus.

A further object of the present invention is the provision of an improved wheel mounting method and apparatus which does not utilize screws and which can be easily assembled.

A further object of the present invention is the provision of an improved wheel mounting method and apparatus which provides a simple and easy way for securing or attaching reinforcing members to a plastic dishwasher rack.

A further object of the present invention is the provision of reinforcing support structure for a plastic dishwasher rack which transfers the load of the contained objects through the rack wheels to the tub of the dishwasher.

A further object of the present invention is the provision of an improved wheel mounting apparatus which is efficient in operation, durable in use, and economical in manufacture.

SUMMARY OF THE INVENTION

The foregoing objects may be achieved by a combination which includes a frame to be supported. A shaft projects outwardly from the frame and comprises an inner end connected to or molded integrally with the frame and an outer end. A bushing includes an inner bushing end and an outer bushing end, a flange adjacent the outer bushing end and a shank portion between the flange and the inner bushing end. The bushing includes a bushing bore extending therethrough and is fitted over the shaft with the shaft extending into the bushing bore. A wheel having a central wheel bore extending therethrough is rotatably mounted over the bushing, with the shank portion of the bushing extending through the wheel bore and providing a bearing surface for rotation of the wheel thereon. The flange of the bushing engages the wheel to prevent axial movement of the wheel off of the outer end of the shaft.

In one modified form of the invention the dishwasher frame includes a plurality of cross frame members or ribs each of which terminate at first and second wheel shafts located at the opposite ends of the cross frame members. Each of the cross frame members has an elongated channel or groove formed therein with opposite channel ends extending at least partially into the first and second wheel shafts.

An elongated reinforcing member is fitted within the elongated channel and has first and second reinforcing ends extending approximately to the opposite channel ends. First and second bushings are fitted over the first and second wheel shaft respectively and surround the first and second channel ends to retain the reinforcing member within the channel. First and second wheels are rotatably mounted on the first and second bushings respectively.

In one modified form of the invention the bushings may be snapped onto shafts for holding the wheels rotatably thereon.

DETAILED DESCRIPTION OF THE PREFERRED EMBODIMENT

Figure 1:
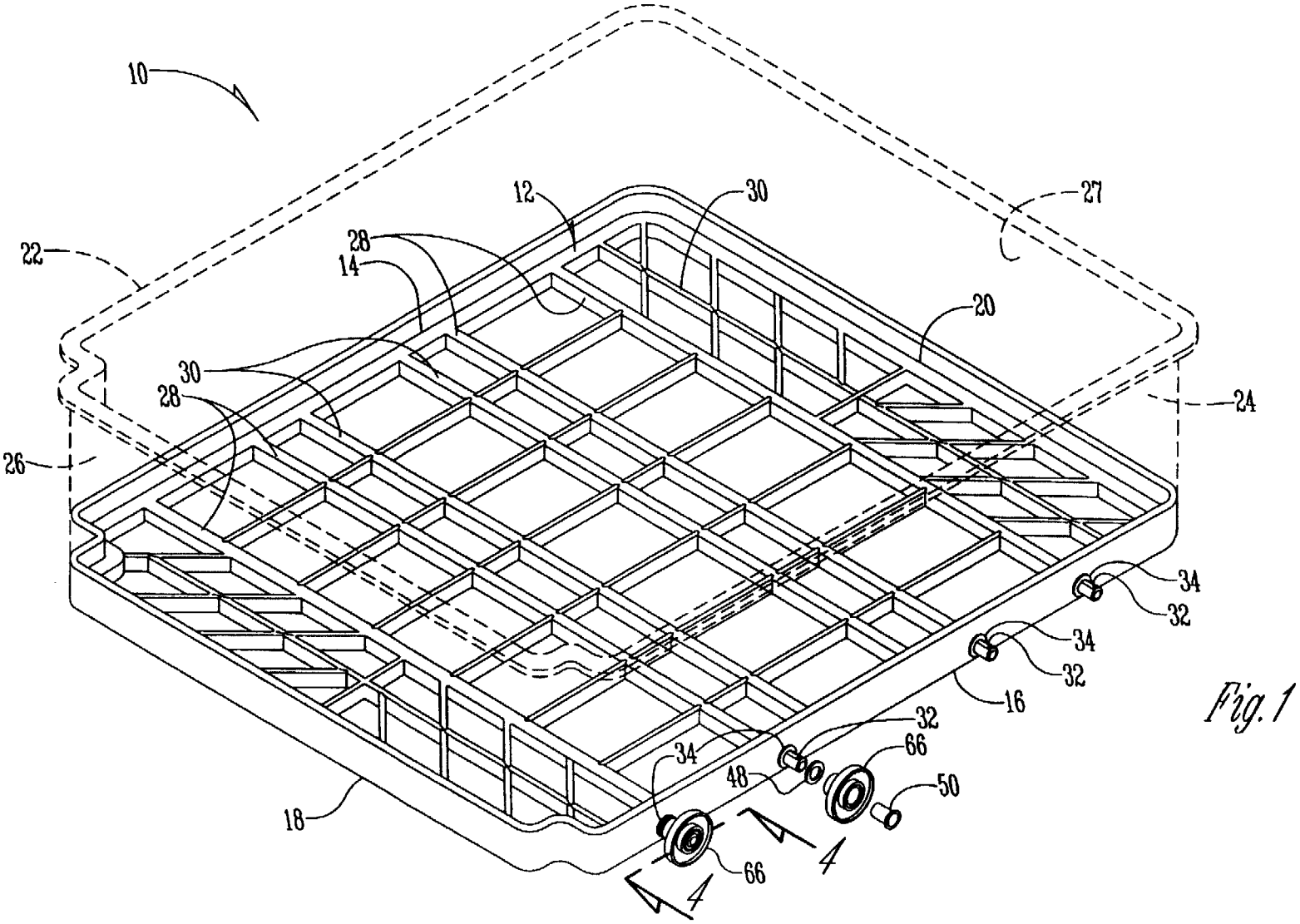
FIG. 1 is a perspective view of a dishwasher rack constructed according to the present invention, and showing the side walls of the rack in phantom lines.
Figure 2:
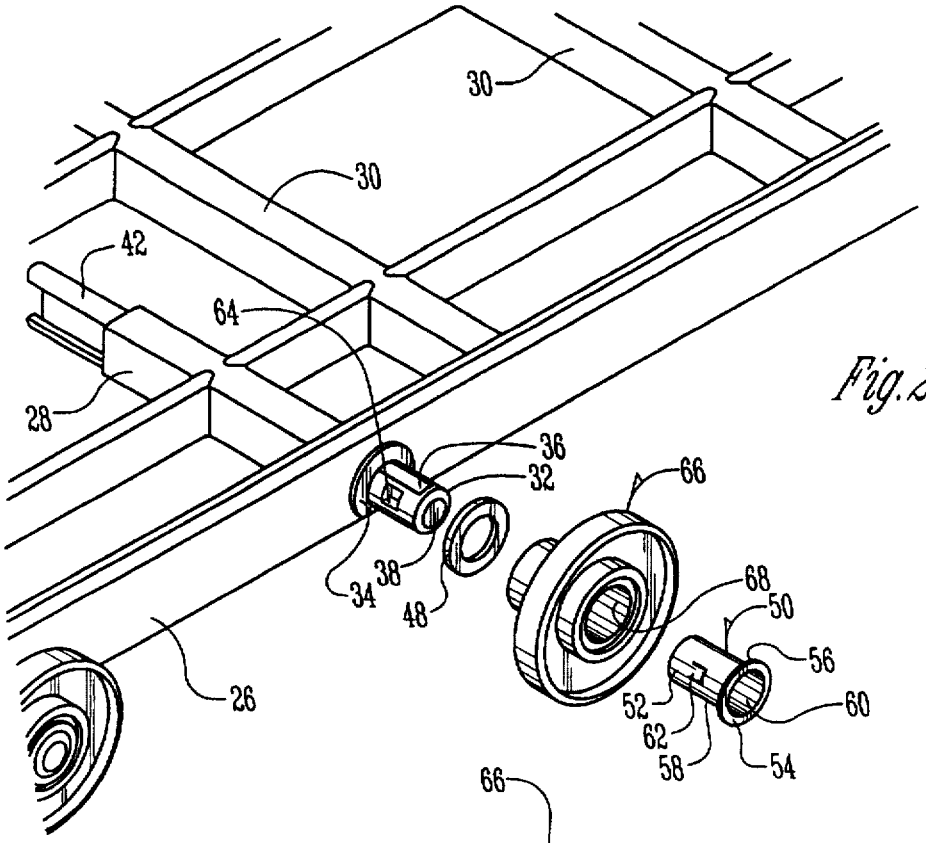
FIG. 2 is an enlarged perspective detail of the wheel shaft of the dishwasher rack, showing the wheel assembly in an exploded view.

Referring to the drawings, the numeral 10 generally designates the dishwasher rack of the present invention. Rack 10 includes a base portion 12 having opposite side edges 14, 16, a front edge 18, and a rear edge 20. Rack 10 also includes upstanding side wall 22, 24, a front wall 26, and a rear wall 27 which extend upwardly from base portion 12 and which are shown in phantom lines.

Figure 5:
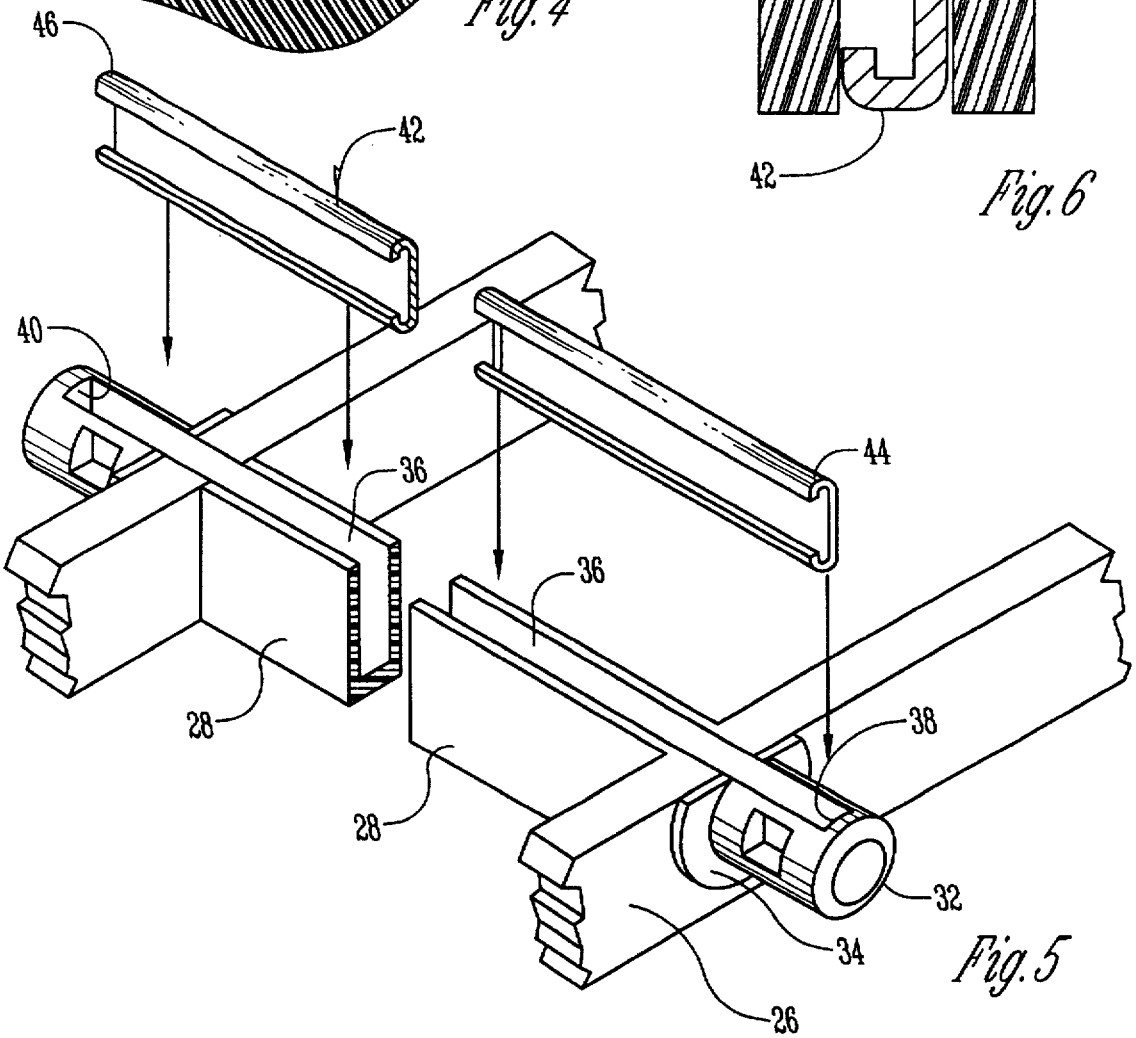
FIG. 5 is an enlarged partial perspective view of the bottom of the dishwasher rack rotated 180° from FIG. 1 and showing the insertion of a reinforcing member into one of the grooves in the bottom of the dishwasher rack.

Extending across the bottom of the rack 10 are a plurality of reinforced cross members or ribs 28 and a plurality of unreinforced cross members or ribs 30. The reinforced cross members or ribs 28 include at their opposite ends a pair of wheel shafts 32 that are substantially circular in cross-section. Surrounding each of the wheel shafts 32 is a partial circular embossment 34. As best shown in FIG. 5, the cross members or ribs 28 are U-shaped and define side-to-side elongated grooves or channels 36. The ribs 28 are preferably U-shaped in cross-section, but may have other configurations without detracting from the invention. At the opposite ends of each groove or channel 36 are first and second groove end closures 38, 40 (FIG. 5) which are positioned so that the ends of the grooves or channels 36 protrude within each of the opposite wheel shafts 32.

A metal reinforcing member 42 is fitted within each of the grooves or channels 36 and includes first and second ends 44, 46 which are adjacent the end closures 38 and 40 respectively of groove 36.

Figure 3:
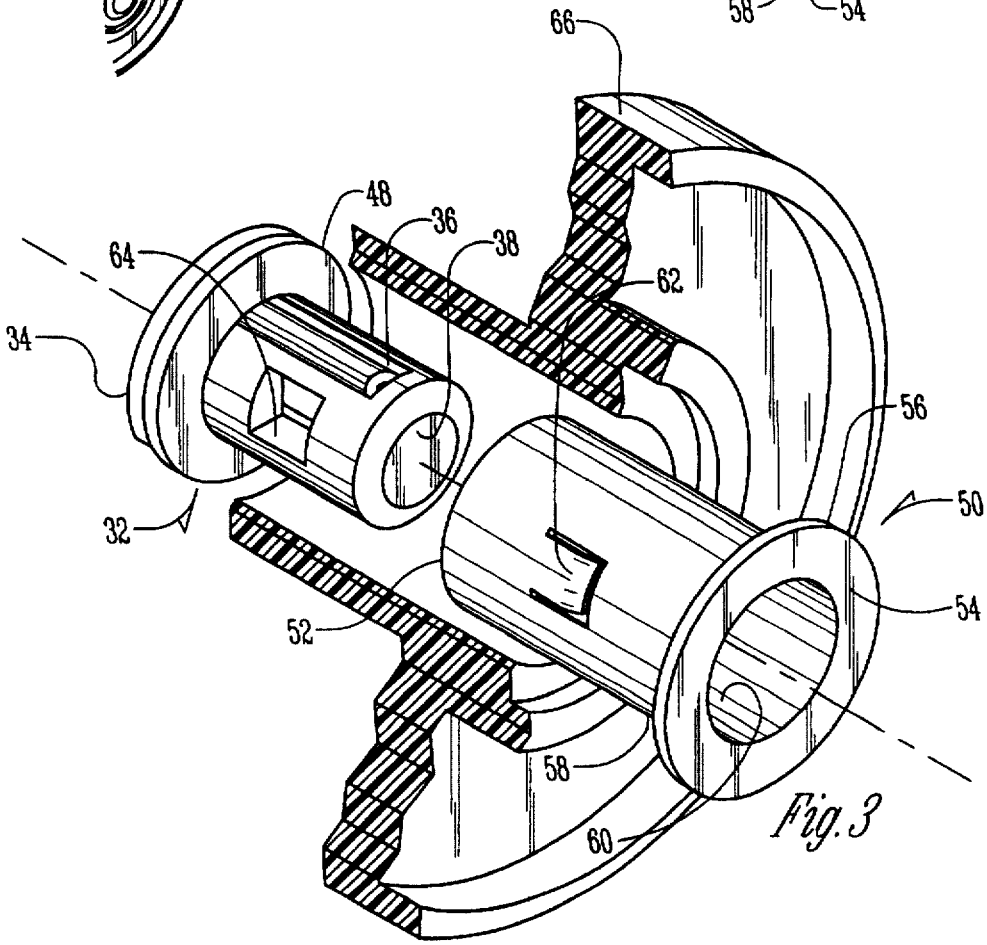
FIG. 3 is an enlarged detail exploded view similar to FIG. 2.

A washer 48 is slipped over the shaft 32 and against the embossment 34 so as to hold the reinforcing member 42 within the groove 36 and to provide a thrust bearing surface for the wheel 66. A bushing 50 includes an inner end 52, and an outer end 54 having a flange 56 thereon. A shank portion 58 extends between the inner end 52 and the flange 56. Extending axially through the bushing 50 is a bushing bore 60. Within the shank portion 58 of bushing 50 is at least one clip or clip finger 62 which is bent radially inwardly and which is adapted to engage a clip cavity or receptacle 64 in wheel shaft 32 as can be seen in FIG. 3.

A wheel 66 includes a wheel bore 68 extending therethrough. The wheel 66 is mounted on the bushing 50 with the shank portion 58 of bushing 50 rotatably extending through bore 68. The bushing 50 is then pressed onto the wheel shaft 32 until the clip finger 62 snaps into the clip receptacle 64 on wheel shaft 32. This locks the bushing 50 onto the wheel shaft 32, with the bushing flange 56 preventing the removal of the wheel 66 from the outer end of bushing 50 and shaft 32.

Figure 4:
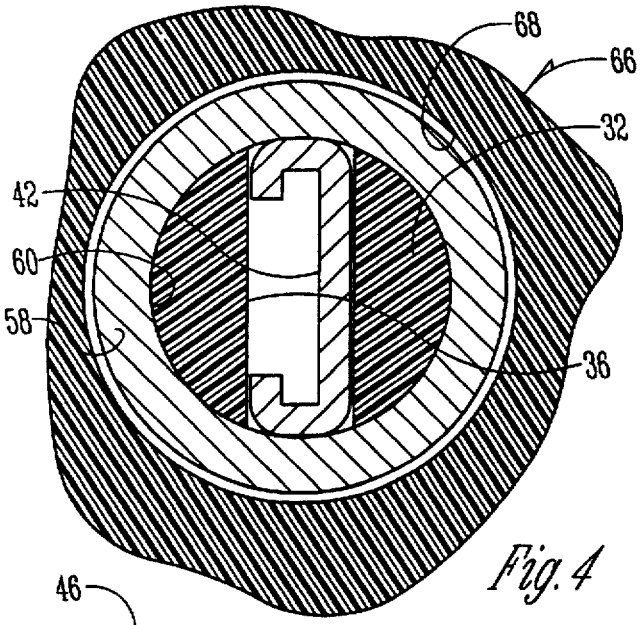
FIG. 4 is a sectional view taken generally along line 4—4 of FIG. 1.

The method of assembly of this device is very simple. The reinforcing member 42 is first placed within the groove 36 as shown in FIG. 5. Next the washers 48 are slipped over the ends of wheel shafts 32 so as to retain the opposite ends of the reinforcing member 42 within the groove 36. Next the wheels 66 are mounted on the shank portions 58 of bushings 50 and the bushings 50 are snapped onto the wheel shafts 32. The bushings 50 engage the reinforcing member 42 as can best be seen in FIG. 4 and retain the reinforcing member within the groove 36.

While clip fingers such as finger 62 and receptacles 64 are shown for securing the bushings 50 on the shaft 32, other securing means may be used. A press fit between the bushing bore 60 and the wheel shaft 32 may be sufficient to retain the wheels 66 on the wheel shafts 32. Also, barbs may be placed on the interior surface of the bushing bore 60 for retaining and frictionally holding the outer surface of the wheel shaft 32. One of the primary advantages obtained by the present invention is the ability to snap the wheels 66 in place and by so doing to lock the reinforcing members 42 in place within the grooves 36. The reinforcing member 42 prevents the bending of the reinforced cross members or ribs 28 and also transfers the weight within the dishwasher rack 10 through the wheels 66 to the track within the dishwasher tub (not shown).

Preferably the rack 10 is molded from plastic material and the wheels 66 are also formed from plastic material. The bushings 50 and the reinforcing members 42 are preferably formed of stainless steel so as to resist rusting. While a C-shaped cross-sectional configuration is shown for reinforcing members 42, other cross-sectional configurations may be utilized without detracting from the invention.

Figure 6:
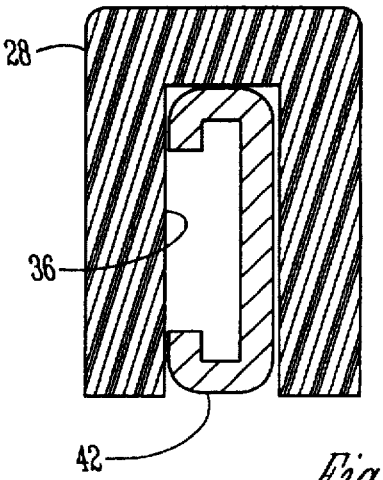
FIG. 6 is a sectional view taken generally along line 6—6 of FIG. 1.

The grooves 36 extend diametrically completely through the wheel shafts 32, but preferably do not extend completely through the U-shaped cross-sectional portions of reinforcing cross members or ribs 28 such as shown in FIG. 6.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. In combination:

a frame to be supported;

a shaft comprised of plastic projecting outwardly from said frame and comprising an inner shaft end connected to said frame and an outer shaft end;

a reinforcing member positioned adjacent said shaft;

a bushing having an inner bushing end, and an outer bushing end, a flange adjacent said outer bushing end, and a shank portion between said flange and said inner bushing end;

said bushing having a bushing bore extending therethrough;

said shaft and said reinforcing member extending within said bushing bore and being held together by said bushing;

a wheel having a central wheel bore extending therethrough;

said shank portion of said bushing extending through said central wheel bore and providing a bearing surface for rotation of said wheel;

said flange of said bushing engaging said wheel to limit axial movement of said wheel.

2. The combination of claim 1 wherein said shaft includes an elongated channel extending at least partially along the length thereof.

3. The combination of claim 2 wherein an elongated reinforcing member is contained within said shaft.

4. The combination of claim 3 wherein said reinforcing member is comprised of metal.

5. The combination of claim 4 wherein said reinforcing member is fitted within said elongated channel.

6. The combination of claim 1 and further including locking means for retentively holding said bushing on said shaft.

7. The combination of claim 6 wherein said locking means comprises a press fit of said shaft within said bushing bore.

8. The combination of claim 6 wherein said locking means comprises a clip member on one of said bushing and said shaft and a clip receptacle on the other of said bushing and said shaft, said clip member and said clip receptacle retentively engaging one another.

9. The combination of claim 6 wherein said locking means comprises a barb on said bushing for retentively engaging said shaft.

10. In combination:

a frame assembly to be supported, said frame assembly having one or more elongated cross frame members, each of said cross frame members having first and second wheel shafts at each of its opposite ends respectively, and having an elongated channel formed therein with opposite channel ends extending at least partially into said first and second wheel shafts respectively;

an elongated reinforcing member fitted within said elongated channel and having first and second reinforcing ends extending approximately to said opposite channel ends;

first and second bushings fitted over said first and second wheel shafts respectively and surrounding said first and second channel ends to retain said reinforcing member within said elongated channel;

first and second wheels rotatably mounted on said first and second bushings respectively.

11. The combination according to claim 10 wherein said cross frame member is comprised of plastic and said reinforcing member is comprised of metal.

12. The combination according to claim 11 wherein said reinforcing member is C-shaped in cross-section.

13. The combination according to claim 10 wherein said first and second wheel shafts each include a distal end, said opposite channel ends terminating short of said distal ends whereby said distal ends of said first and second shafts form end closures for said opposite channel ends.

14. The combination according to claim 10 and further including securing means for retentively holding said first and second bushings on said first and second shafts respectively.

15. The combination of claim 10 wherein said frame assembly comprises a dish rack for a dishwasher.

16. A method for attaching a wheel to a shaft projecting outwardly from a frame assembly of a dish rack of a dishwasher, said method comprising:

inserting a reinforcing member into an elongated channel of said shaft;

rotatably mounting a wheel on a shank portion of a bushing, said bushing having a flange on one end of said shank portion for engaging said wheel to prevent axial removal of said wheel from said one end of said shank portion, said shank portion having an axial bushing bore extending therethrough;

fitting said shank portion over said shaft and said reinforcing member so that said shaft and said reinforcing member extend within said bushing bore and are held together by said shank portion; and operatively attaching said bushing on said shaft.

17. A method according to claim 16 wherein said attaching step is accomplished by frictionally engaging said shaft with said bushing bore.

18. A method according to claim 17 wherein said frictional engaging step is accomplished by retentively engaging a clip on one of said bushing and shaft with a clip receptacle on the other of said bushing and shaft.

19. A method according to claim 16 wherein said shaft is positioned at one end of an elongated cross frame member, said channel having a first channel end portion extending into said shaft and a portion of said channel being in said cross frame member, said method further comprising inserting said elongated reinforcing member into said channel with a first end of said reinforcing member extending into said first channel end portion, said insertion of said reinforcing member being done before said step of fitting said shaft into said axial bushing bore whereby said bushing will retain said first end of said reinforcing member within said first channel end portion.

* * * * *